US008983342B2

(12) United States Patent
Koyama et al.

(10) Patent No.: US 8,983,342 B2
(45) Date of Patent: Mar. 17, 2015

(54) DEVELOPER STORAGE CONTAINER, IMAGE FORMING UNIT AND IMAGE FORMING APPARATUS

(71) Applicant: Oki Data Corporation, Tokyo (JP)

(72) Inventors: Tetsu Koyama, Tokyo (JP); Takuya Goto, Tokyo (JP); Junichi Ito, Tokyo (JP); Tatsuya Murakami, Tokyo (JP)

(73) Assignee: Oki Data Corporation, Tokyo (JP)

( * ) Notice: Subject to any disclaimer, the term of this patent is extended or adjusted under 35 U.S.C. 154(b) by 85 days.

(21) Appl. No.: 13/721,227

(22) Filed: Dec. 20, 2012

(65) Prior Publication Data

US 2013/0164041 A1 Jun. 27, 2013

(30) Foreign Application Priority Data

Dec. 27, 2011 (JP) ..... 2011-285077

(51) Int. Cl.
*G03G 15/08* (2006.01)
*G03G 15/01* (2006.01)

(52) U.S. Cl.
CPC ..... *G03G 15/0877* (2013.01); *G03G 15/0886* (2013.01); *G03G 15/0194* (2013.01); *G03G 2215/0141* (2013.01)
USPC ..... 399/260

(58) Field of Classification Search
USPC ..... 399/103, 105, 106, 258, 260, 262
See application file for complete search history.

(56) References Cited

U.S. PATENT DOCUMENTS

2009/0016767 A1* 1/2009 Koido ..... 399/106

FOREIGN PATENT DOCUMENTS

| | | |
|---|---|---|
| JP | 2001-042620 A | 2/2001 |
| JP | 2006-243446 A | 9/2006 |
| JP | 2008-209865 A | 9/2008 |

* cited by examiner

*Primary Examiner* — Hoang Ngo
(74) *Attorney, Agent, or Firm* — Rabin & Berdo, P.C.

(57) ABSTRACT

A developer storage container includes a storage portion for storing a developer therein, an opening for ejecting the developer stored in the storage portion, and an opening-and-closing member for opening and closing the opening. A concave portion is formed on the opening-and-closing member so that the concave portion faces the opening.

18 Claims, 9 Drawing Sheets

COMPARISON EXAMPLE

COMPARISON EXAMPLE

DEVELOPER STORAGE CONTAINER, IMAGE FORMING UNIT AND IMAGE FORMING APPARATUS

BACKGROUND OF THE INVENTION

The present invention relates to a developer storage container, an image forming unit and an image forming apparatus.

An image forming apparatus such as a printer, a copier, a facsimile machine and a multifunction peripheral includes an image forming unit. The image forming unit includes a main body (i.e., an image forming unit main body) and a toner cartridge (i.e., a developer storage container) detachably mounted to the image forming unit main body.

The toner cartridge includes a case storing a toner (i.e., a developer) therein. The case has an opening through which the toner is supplied to the image forming unit main body. A shutter is rotatably provided in the case so as to open and close the opening. The image forming unit main body has a receiving opening for receiving the toner supplied by the toner cartridge (see, for example, Japanese Laid-open Patent Publication No. 2006-243446).

In this regard, when the shutter is rotated to close the opening, the toner adhering to the receiving opening of the image forming unit main body may adhere to an outer surface of the shutter. Therefore, when the toner cartridge is detached from the main body, the toner adhering to the shutter may scatter outside. The scattered toner may contaminate surroundings, i.e., a case of the toner cartridge, a housing of the image forming unit main body, and an interior of the image forming apparatus.

SUMMARY OF THE INVENTION

An aspect of the present invention is intended to provide a developer storage container, an image forming unit and an image forming apparatus capable of preventing scattering of a developer upon detaching of the developer storage container, and capable of preventing the developer from contaminating surroundings.

According to an aspect of the present invention, there is provided a developer storage container including a storage portion for storing a developer therein, an opening for ejecting the developer stored in the storage portion, and an opening-and-closing member for opening and closing the opening. A concave portion is formed on the opening-and-closing member so that the concave portion faces the opening.

Since the opening-and-closing member has the convex portion at the position facing the opening, the developer is prevented from adhering to an outer surface of the shutter. Therefore, it becomes possible to prevent the developer from scattering, and to prevent the developer from contaminating the surroundings.

According to another aspect of the present invention, there is provided an image forming unit including the developer storage container.

According to further aspect of the present invention, there is provided an image forming apparatus including the developer storage container.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to drawings. Description will be made of a color printer as an example of an image forming apparatus.

First Embodiment

Figure 1:
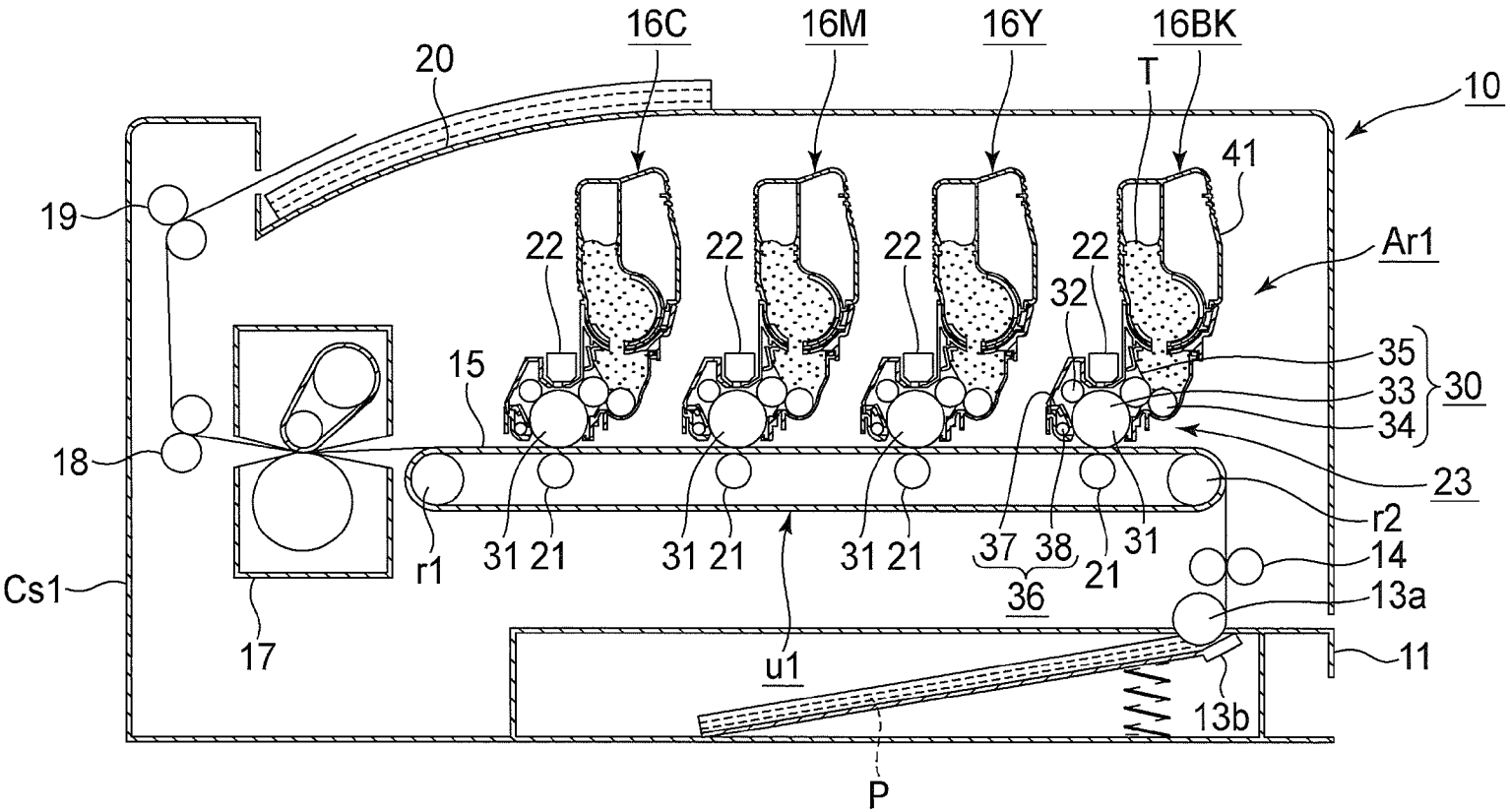
FIG. 1 is a schematic sectional view showing a printer as an image forming apparatus according to the first embodiment of the present invention.
Figure 2:
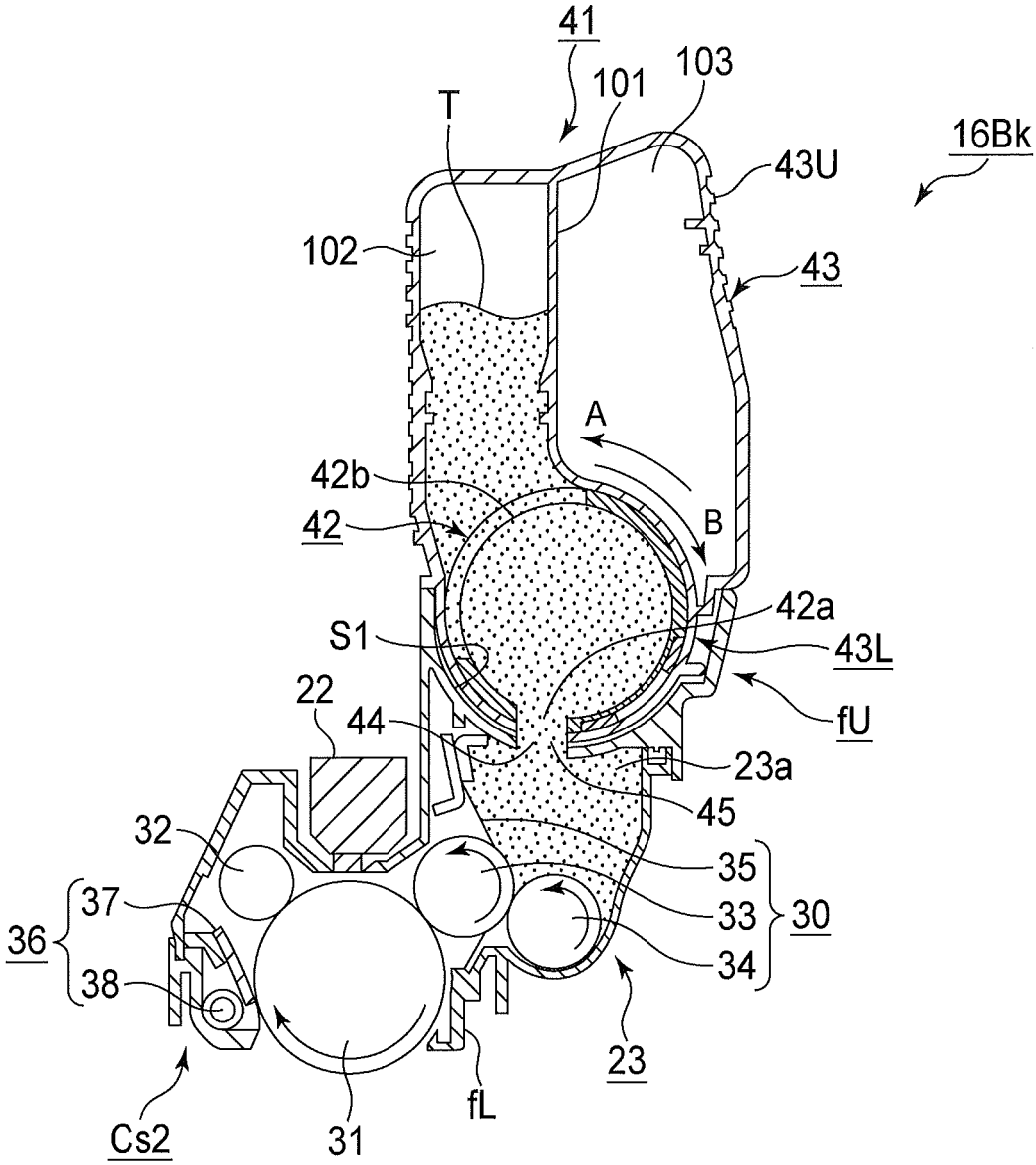
FIG. 2 is a schematic sectional view showing an image forming unit according to the first embodiment.
Figure 3:
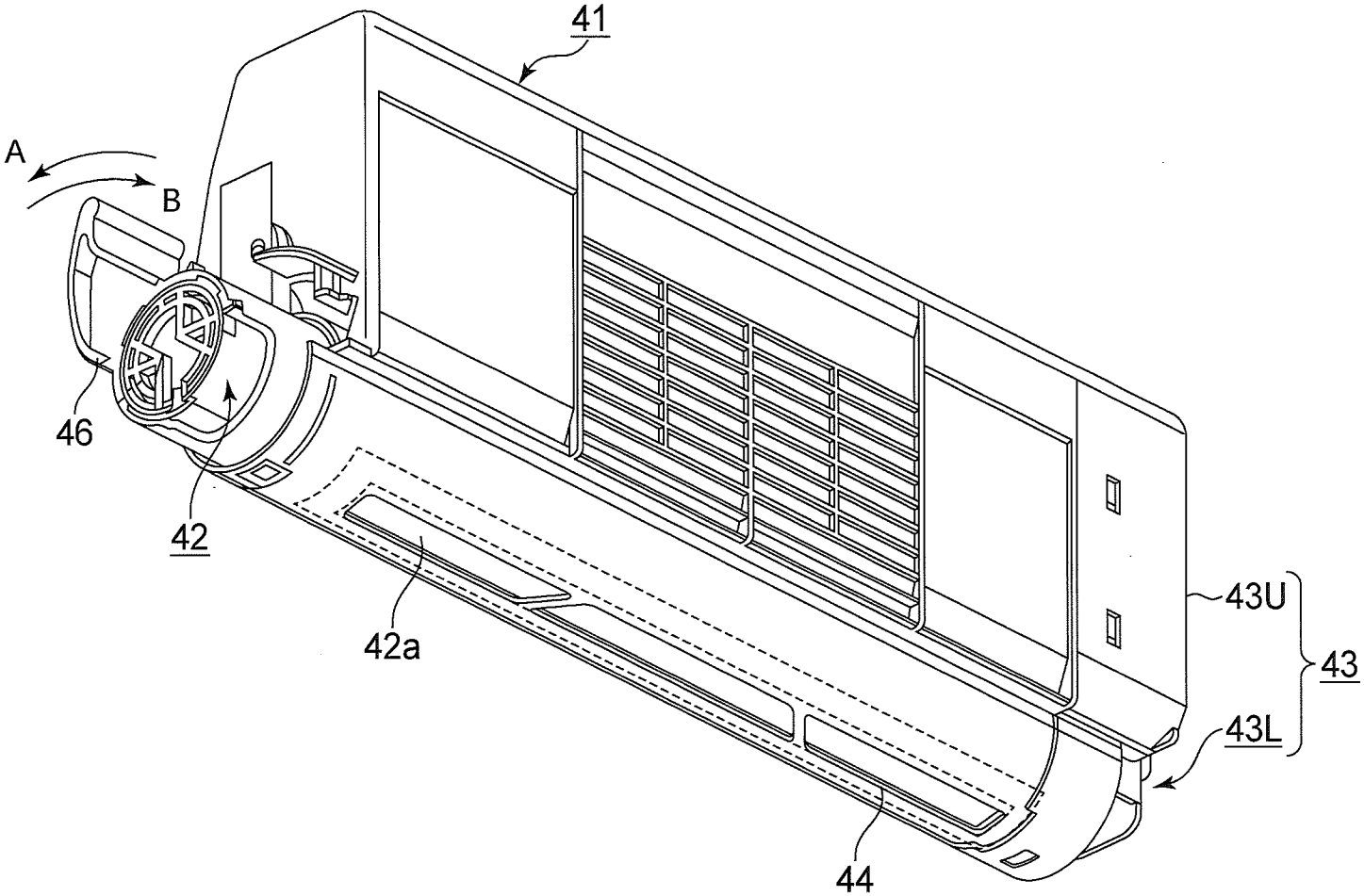
FIG. 3 is a perspective view showing a toner cartridge according to the first embodiment.

FIG. 1 is a schematic sectional view showing a printer as an example of an image forming apparatus according to the first embodiment of the present invention. FIG. 2 is a schematic sectional view showing an image forming unit according to the first embodiment. FIG. 3 is a perspective view showing a toner cartridge of the image forming unit according to the first embodiment. In this regard, the image forming units 16Bk, 16Y, 16M and 16C (described later) have the same configurations, and therefore FIGS. 2 and 3 show the image forming unit 16Bk only.

As shown in FIG. 1, the printer 10 includes a medium cassette 11 at a lower part thereof. The medium cassette 11 stores a stack of sheets (i.e., media) P. A medium feeding mechanism is provided on a front side (i.e., right side in FIG. 1) of the medium cassette 1. The medium feeding mechanism is configured to feed the sheets P one by one into a conveying path. The medium feeding mechanism includes a hopping roller 13*a*, a separating device 13*b* and the like. Conveying rollers 14 are provided on a downstream side of the medium feeding mechanism in a conveying direction of the sheet P along the conveying path.

The conveying rollers 14 are configured to convey the sheet P to an image forming portion Ar1 provided on a downstream side of the conveying rollers 14 in the conveying direction of the sheet P.

The image forming portion Ar1 includes the image forming units (also referred to as image drum units) 16Bk, 16Y, 16M and 16C. The image forming units 16Bk, 16Y, 16M and 16C are arranged in this order from an upstream side to a downstream side in the conveying direction of the sheet P. The image forming units 16Bk, 16Y, 16M and 16C are respectively configured to form toner images (i.e., developer images) of black, magenta, yellow and cyan. The image forming units 16Bk, 16Y, 16M and 16C are detachably mounted to a main body of the printer 10.

The image forming portion Ar1 further includes a transfer unit u1 provided along and below the image forming units 16Bk, 16Y, 16M and 16C. The image forming portion An further includes LED (Light Emitting Diode) heads 22 as an exposure device provided so as to face photosensitive drums 31 (described below) of the image forming units 16Bk, 16Y, 16M and 16C.

Each of the image forming units 16Bk, 16Y, 16M and 16C includes a main body (i.e., an image forming unit main body) 23 and a toner cartridges 41 (i.e., a developer storage container) detachably mounted to the image forming unit main body 23. The toner cartridges 41 of the image forming units 16Bk, 16Y, 16M and 16C respectively store toner T (i.e., developer) of black, yellow, magenta and cyan.

The photosensitive drum 31 (i.e., an image bearing body) is rotatably provided in the image forming unit main body 23. The photosensitive drum 31 rotates at a constant speed by a power transmitted from a not shown driving motor (i.e., a driving source). A charging roller 32 (i.e., a charging member) is rotatably provided so as to contact the photosensitive drum 32. The charging roller 32 is applied with a predetermined voltage by a charging power source (not shown). The charging roller 32 rotates in a direction opposite to the photosensitive drum 31, and uniformly charges a surface of the photosensitive drum 31. The LED head 22 emits light so as to expose the surface of the photosensitive drum 31, and forms a latent image on the surface of the photosensitive drum 31.

A developing unit 30 is provided adjacent to the photosensitive drum 31. The developing unit 30 is configured to develop the latent image on the surface of the photosensitive drum 31 to form a toner image (i.e., a developer image). The developing unit 30 includes a developing roller 33 (i.e., a developer bearing body) rotatably provided so as to contact or face the photosensitive drum 31. The developing roller 33 rotates in a direction opposite to the photosensitive drum 31, and causes the toner T to adhere to the latent image. The developing unit 30 further includes a toner supply roller 34 (i.e., a developer supply member) rotatably provided so as to contact the developing roller 33. The toner supply roller 34 rotates in the same direction as the developing roller 33, and supplies the toner T to the developing roller 33. A circumferential speed of the toner supply roller 34 is different from a circumferential speed of the developing roller 33 by a predetermined value. The developing unit 30 further includes a developing blade 35 (i.e., a developer layer regulating member) is provided so that a tip of the developing blade 35 contacts the developing roller 33. The developing blade 35 regulates a thickness of a layer of the toner T on the surface of the developing roller 33. The developing unit 30 is configured to perform development using a single component developing method. Therefore, the toner T is a non-magnetic single component toner.

Further, a cleaning device 36 is provided so as to face the photosensitive drum 31. The cleaning device 36 includes a cleaning blade 37 as a cleaning member made of a resilient body. A tip of the cleaning blade 37 is pressed against the photosensitive drum 31 with a predetermined pressure. The cleaning blade 37 scrapes off the toner T remaining on the surface of the photosensitive drum 31 after transfer of the toner image. The cleaning device 36 further includes a spiral 38 that conveys the toner T scraped off by the cleaning blade 37.

The transfer unit u1 includes a driving roller r1 (i.e., a driving member), and a driven roller r2 (i.e., a driven member), and a transfer belt 15 (i.e., a conveying member) stretched around the driving roller r1 and the driven roller r2. The transfer belt 15 is moved by a rotation of the driving roller r1. The transfer unit u1 further includes transfer rollers 21 (i.e., transfer members) provided so as to face the photosensitive drums 31. The transfer belt 15 and the transfer rollers 21 are connected to not shown transfer power sources, and are applied with predetermined transfer voltages.

A fixing unit 17 (i.e., a fixing device) is provided on a downstream side of the image forming unit Ar1 in the conveying direction of the sheet P. The fixing unit 17 is configured to apply heat and pressure to the sheet P thereby to fix the toner image to the sheet P. Conveying rollers 18 are provided on a downstream side of the fixing unit 17, and ejection rollers 19 are provided on a downstream side of the conveying rollers 18. The conveying rollers 18 are configured to convey the sheet P with the fixed toner image. The ejection rollers 19 are configured to eject the sheet P outside the printer 10. A stacker portion 20 is provided on an upper wall of a housing Cs1 of the printer 10, and the ejected sheet P is placed on the stacker portion 20.

In each of the image forming units 16Bk, 16Y, 16M and 16C, the photosensitive drum 31 rotates, and the surface of the photosensitive drum 31 is uniformly charged by the charging roller 32. The surface of the photosensitive drum 31 is exposed with light emitted by the LED head 22, and a latent image is formed on the surface of the photosensitive drum 31.

In the developing unit 30, the toner supply roller 34 supplies the toner T to the developing roller 33 by means of a potential difference between the toner supply roller 34 and the developing roller 33, and also scrapes off excess toner on the developing roller 33.

As the developing roller 33 rotates, the toner T on the developing roller 33 is regulated by the developing blade 35, and a toner layer of a constant thickness is formed on the developing roller 33. When the toner T on the developing roller 33 reaches a region (i.e., a developing region) facing the photosensitive drum 31, the toner T adheres to the latent image on the photosensitive drum 31 by means of electrostatic force caused by the latent image on the photosensitive drum 31, so that a toner image is formed.

The sheets P stored in the medium cassette 11 are fed and separated into a single sheet P by the hopping roller 13*a* and the separation device 13*b*. The conveying rollers 14 correct skew of the sheet P, and convey the sheet P to the image forming portion Ar1.

The sheet P reaching the image forming portion An is conveyed by the transfer belt 15, and passes through between the image forming units 16Bk, 16Y, 16M and 16C and the transfer rollers 21. As the sheet P passes through between the image forming units 16Bk, 16Y, 16M and 16C and the transfer rollers 21, toner images of respective colors are transferred to the sheet P by the transfer rollers 21. As a result, a color toner image is transferred to the sheet P.

Then, the sheet P is conveyed to the fixing unit 17, and the color toner image is fixed to the sheet P. The sheet P is conveyed by the conveying rollers 18, and is ejected outside the printer 10 by the ejection rollers 19. The ejected sheet P is placed on the stacker portion 20.

In this regard, the toner cartridges 41 are detachably mounted to the image forming unit main bodies 23 of the image forming units 16Bk, 16Y, 16M and 16C. The toner cartridges 41 supply the toner T to the developing units 30 of the image forming unit main bodies 23.

As shown in FIG. 2, the toner cartridge 41 has a case 43 (i.e., a housing). The case 43 is divided by a partition wall 101 into a toner storage chamber 102 (i.e., a developer storage portion or a reservoir) and a waste toner storage chamber 103 (i.e., a waste developer storage chamber). The toner storage chamber 102 stores a fresh toner T. The waste toner storage chamber 102 stores a waste toner having been conveyed by the spiral 38.

The case 43 includes an upper half portion 43U having a rectangular cross section and a lower half portion 43L having a semicircular cross section (i.e., a semicylindrical shape). An opening 44 (i.e., a developer opening) is formed on a bottom of the lower half portion 43L. The toner T (stored in the toner storage chamber 102) is supplied to the image forming unit main body 23 through the opening 44. The opening 44 is elongated in a longitudinal direction of the toner cartridge 41. In this regard, the longitudinal direction of the toner cartridge 41 is the same as a widthwise direction of the transfer belt 15, and is perpendicular to the conveying direction of the sheet P.

The image forming unit main body 23 has a housing Cs2 including a lower frame fL and an upper frame fU. A mounting portion S1 is formed on the upper frame fU. The mounting portion S1 is provided for mounting the toner cartridge 41. The mounting portion S1 has a concave shape having a semicircular cross section (i.e., semicylindrical shape) corresponding to the lower half portion 43L of the toner cartridge 41. The mounting portion S1 is elongated in the widthwise direction of the transfer belt 15, and is perpendicular to the conveying direction of the sheet P. A receiving opening 45 (i.e., a developer receiving portion) is formed on the mounting portion S1. The receiving opening 45 is provided so as to correspond to the opening 44 of the toner cartridge 41. The receiving opening 45 receives the toner T supplied via the opening 44. The opening 44 and the receiving opening 45 have the same shape and the same size. When the toner cartridge 41 is mounted to the image forming unit main body 23, the opening 44 and the receiving opening 45 are aligned with each other.

A shutter 42 (i.e., an opening-and-closing member or a shield member) is provided in the toner storage chamber 102 for opening and closing the opening 44. The shutter 42 has a cylindrical shape. The shutter 42 is movable. More specifically, in this embodiment, the shutter 42 is rotatable about a rotation axis that coincides with a center axis of the shutter 42 having the cylindrical shape. The shutter 42 is rotatable in a direction shown by an arrow B (FIG. 4) and in an opposite direction. As the shutter 42 rotates (more specifically, rotates), an inner circumferential surface of the lower half portion 43L and an outer circumferential surface of the shutter 42 slide with respect to each other.

A supply opening 42*a* (i.e., a developer supply portion) and a connecting portion 42*b* are formed on the shutter 42. The supply opening 42*a* is provided at a predetermined position in a circumferential direction corresponding to the opening 44. A connecting portion 42*b* is provided at a position different from the supply opening 42*a*. The supply opening 42*a* and the connecting portion 42*b* are elongated in an axial direction (i.e., the longitudinal direction of the toner cartridge 41).

When an operator operates an operation lever 46 formed integrally with the shutter 42 to rotate the shutter 42 in a direction shown by an arrow A, the shutter 42 rotates in the direction shown by the arrow A by a predetermined amount, and reaches an opening position where the shutter 42 opens the opening 44. In the opening position, the opening 44 and the supply opening 42*a* are aligned with each other, so that the toner storage chamber 102 and an interior of the image forming unit main body 23 are connected with each other. In this state, the toner T in the toner storage chamber 102 is supplied to a toner hopper 23*a* (i.e., a developing holding portion) of the image forming unit main body 23 via the opening 44, the supply opening 42*a* and the receiving opening 45. The toner hopper 23*a* is a portion where the toner T is temporality held.

Further, when the operator operates the operation lever 46 to rotate the shutter 42 in the direction shown by the arrow B, the shutter 42 rotates in the direction shown by the arrow B, and reaches a closing position where the shutter 42 closes the opening 44. In the closing position, the opening 44 and the supply opening 42*a* are displaced from each other, so that the toner storage chamber 102 and the interior of the image forming unit main body 23 are not connected with each other. Therefore, supply of the toner T is stopped.

If an amount of the toner T stored in the toner cartridge 31 becomes small, the operator replaces the toner cartridge 41 with new toner cartridge. Upon replacement of the toner cartridge 41, when the operator operates the operation lever 46 to rotate the shutter 42 in the direction shown by the arrow B from the opening position to the closing position to close the opening 44, the toner T adhering to the receiving opening 45 of the image forming unit main body 23 may adhere to the shutter 42. Therefore, when the toner cartridge 41 is detached from the image forming unit main body 23, the toner T adhering to the shutter 42 may scatter outside. The scattered toner may contaminate components around the opening 44 such as, for example, the case 43 of the cartridge 41, the housing Cs2 of the image forming unit main body 23, and an interior of the housing Cs1 of the printer 10.

Therefore, the first embodiment is intended to prevent the toner T (adhering to the receiving opening 45 of the image forming unit main body 23) from adhering to the shutter 42 when the shutter 42 closes the opening 44.

Next, mounting and detachment of the toner cartridge 41 to and from the image forming unit main body 23 will be described.

Figure 4:
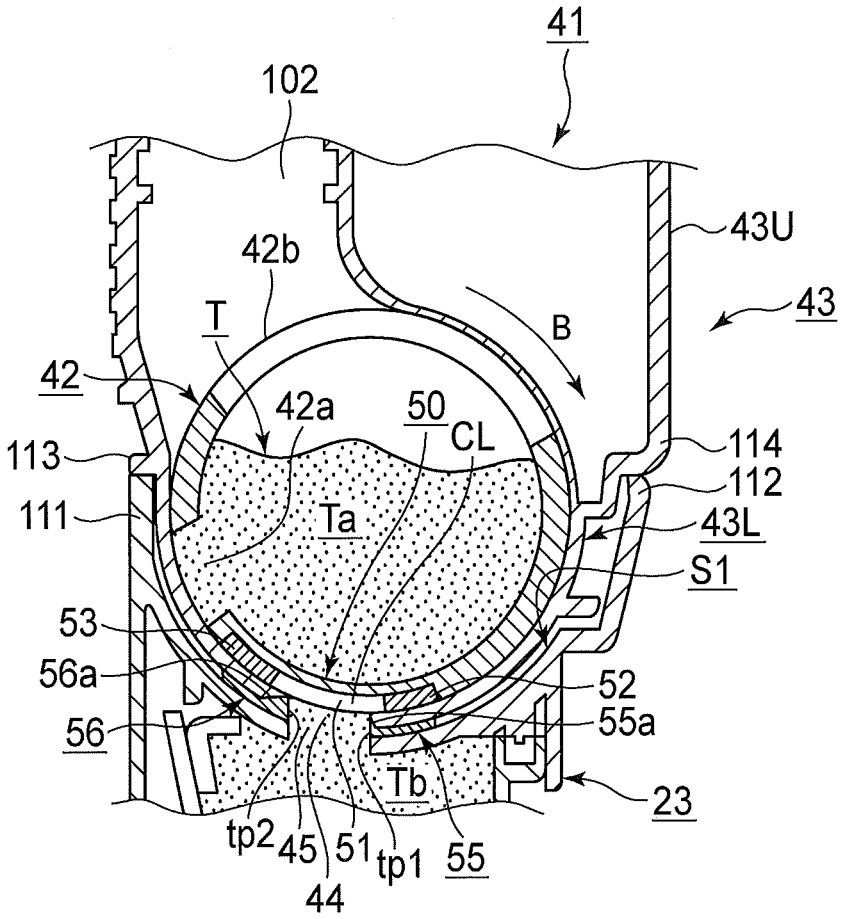
FIG. 4 is a sectional view showing a state where a shutter of the toner cartridge is in a closing position according to the first embodiment.
Figure 5:
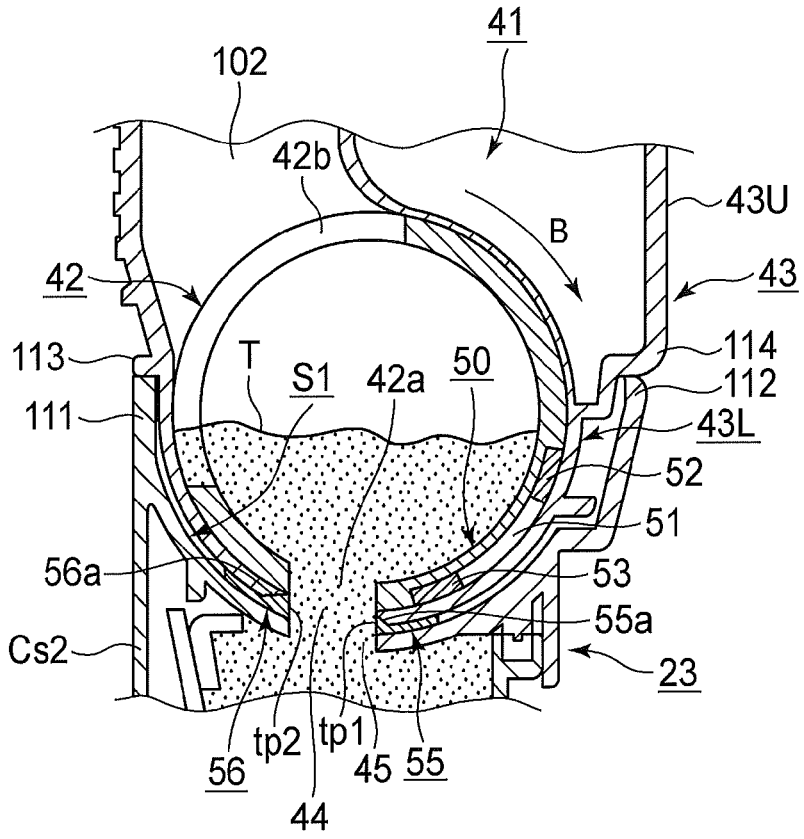
FIG. 5 is a sectional view showing a state where the shutter of the toner cartridge is in an opening position according to the first embodiment.
Figure 6:
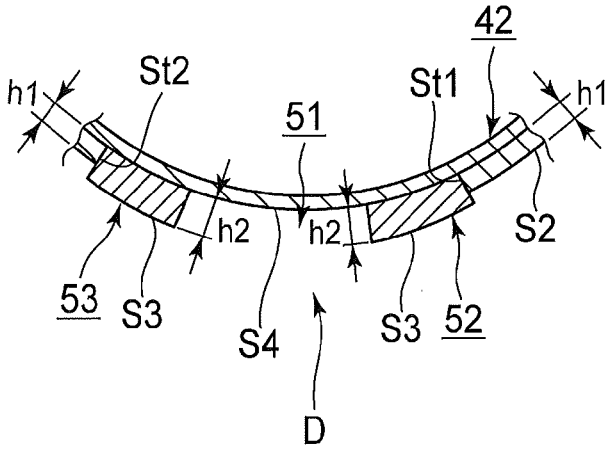
FIG. 6 is an enlarged sectional view showing a main part of the shutter according to the first embodiment in a state where the shutter is not yet mounted to the toner cartridge.
Figure 7:
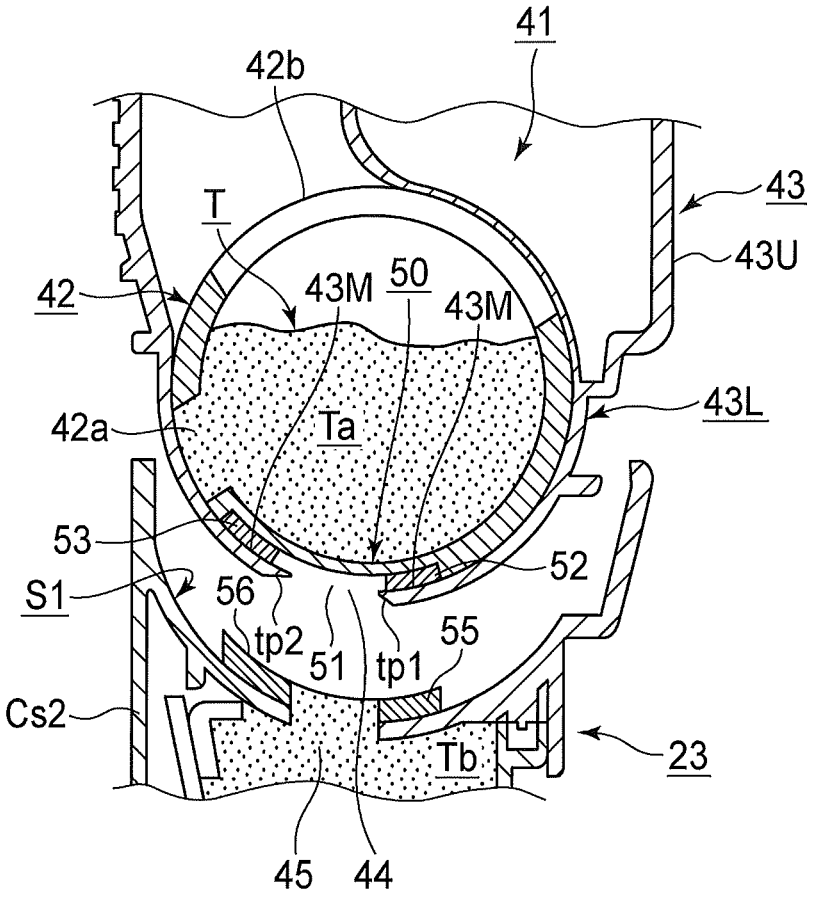
FIG. 7 is a sectional view showing a state where the toner cartridge is detached from an image forming unit main body according to the first embodiment.

FIG. 4 is a sectional view showing a state where the shutter 42 of the toner cartridge 41 is in the closing position. FIG. 5 is a sectional view showing a state where the shutter 42 of the toner cartridge 41 is in the opening position. FIG. 6 is an enlarged sectional view showing a main part of the shutter 42 in a state where the shutter 42 is not yet mounted to the toner cartridge 41. FIG. 7 is a sectional view showing a state where the toner cartridge 41 is detached from the image forming unit main body 23.

As described above, in FIG. 4, the toner cartridge 41 is mounted to the mounting portion S1 of the image forming unit main body 23 of the image forming unit (for example, the image forming unit 16Bk). Supporting portions 111 and 112 are formed on both edges of the mounting portion S1 so as to protrude upward. Supported portions 113 and 114 are formed on the lower half portion 43L of the case 43 so as to protrude horizontally. When the toner cartridge 41 is mounted to the image forming unit main body 23, the supporting portions 111 and 112 contact the supported portions 113 and 114 from below, so that the toner cartridge 41 is correctly positioned with respect to the image forming unit main body 23. In a state where the supporting portions 111 and 112 contact the supported portions 113 and 114, the opening 44 and the receiving opening 45 are aligned with each other.

A closing portion 50 is provided at a predetermined portion of the shutter 42. More specifically, the closing portion 50 is provided at a portion that faces the opening 44 in a state where the shutter 42 is in the closing position. The closing portion 50 is elongated in the axial direction of the shutter 42 (i.e., the longitudinal direction of the toner cartridge 41).

A recess portion 51 is formed on an outer circumference of the closing portion 50. The recess portion 51 is in the form of a groove having a length in the axial direction of the shutter 42. The recess portion 51 has a width over a predetermined region in the circumferential direction of the shutter 42. As shown in FIG. 6, step portions St1 and St2 (i.e., first and second regulating portions or abutting portions) are formed on both ends of the recess portion 51. The step portions St1 and St2 are provided so as to correspond to the opening 44. Further, a pair of seal members 52 and 53 (i.e., first and second resilient members) are provided so as to be pressed against the step portions St1 and St2. The seal members 52 and 53 are apart from each other in the rotational direction (i.e., movable direction) of the seal member 42. The seal members 52 and 53 extend in the longitudinal direction of the recess portion 51. The seal members 52 and 53 are bonded to a bottom surface S4 of the recess portion 51 using a not shown double-faced adhesive tape (i.e., a fixing member) in such a manner that the seal members 52 and 53 contact the inner circumferential surface 43M of the lower half portion 43L. The recess portion 51, the seal members 52 and 53 and the step portions St1 and St2 constitute a concave portion D.

In this regard, the seal member 52 is provided on an upstream side of the seal member 53 in a direction in which the shutter 42 rotates from the opening position toward the closing position. More specifically, the seal member 52 is provided on the upstream side of the seal member 53 in the rotational direction shown by the arrow B. Further, a width of each of the seal members 52 and 53 in the circumferential direction of the shutter 42 is wider than a width of the opening 44 in the same direction. The step portion St1 is provided on the upstream side of the seal member 52 in the rotational direction shown by the arrow B. The position of the step portion St1 is determined based on the widths of the opening 44 and the seal member 52. The step portion St2 is provided on the downstream side of the seal member 53 in the rotational direction shown by the arrow B. The position of the step portion St2 is determined based on the widths of the opening 44 and the seal member 53.

The seal members 52 and 53 are made of resilient material whose hardness is lower than hardness of plate material of the housing Cs2 of the image forming unit main body 23 and the case 43 of the toner cartridge 41. For example, the seal members 52 and 53 are made of urethane sponge. As shown in FIG. 6, in a state where the shutter 42 is not yet mounted to the toner cartridge 41, outer circumferential surfaces S3 of the seal members 52 and 53 are positioned outside an outer circumferential surface S2 of the shutter 42. That is, a distance h2 from a bottom surface S4 of the recess portion 51 to the outer circumferential surface S3 of the seal members 52 and 53 is longer than a distance h1 from the bottom surface S4 of the recess portion 51 to the outer circumferential surface S2 of the shutter 42. The shutter 42 is inserted into the toner cartridge 41 while causing the seal members 52 and 53 to be compressed (deformed).

Therefore, in a state where the shutter 42 is in the closing position, the outer circumferential surface S2 of the shutter 42 and the inner circumferential surface of the lower half portion 43L tightly contact each other due to a force caused by deformation of the seal members 52 and 53. Accordingly, the toner T in the toner cartridge 41 is prevented from leaking outside.

Further, the seal members 52 and 53 are pressed against the step portions St1 and St2, and therefore deformation of the seal members 52 and 53 in the circumferential direction can be prevented. Therefore, sealing between the outer circumferential surface S2 of the shutter 42 and the inner circumferential surface 43M of the lower half portion 43L can be ensured. In the state where the toner cartridge 41 is mounted to the image forming unit main body 23, when the operator operates the operation lever 46 (FIG. 4) to rotate the shutter 42 in the direction shown by the arrow B from the opening position to the closing position to close the opening 44, the opening 44 and the supply opening 42*a* are displaced from each other. In this state, the closing portion 50 of the shutter 42 faces the opening 44 and the receiving opening 45.

In this regard, as shown in FIG. 4, the toner T is divided by the closing portion 50 into a toner Ta in the toner storage chamber 102 and a toner Tb in the image forming unit main body 23. In this state, since the closing portion 50 has the recess portion 51, a clearance CL where no toner T exists is formed between the closing portion 50 and a top surface of the toner Tb in the image forming unit main body 23.

Therefore, in the state where the shutter 42 is in the closing position, the toner Tb in the image forming unit main body 23 does not adhere to the surface of the shutter 42 (more specifically, the bottom surface S4 of the recess portion 51).

Further, since a width (i.e., a distance) between the seal members 52 and 53 is wider than the width of the opening 44, the toner Tb in the image forming unit main body 23 does not adhere to the seal members 52 and 53.

As a result, as shown in FIG. 7, when the toner cartridge 41 is detached from the image forming unit main body 23, scattering of the toner T does not occur. Accordingly, components around the opening 44 of the toner cartridge 41 such as, for example, the case 43 of the toner cartridge 41, the housing Cs2 of the image forming unit main body 23 and the housing Cs1 of the printer 10 (FIG. 2) are not contaminated with the toner T.

In addition, seal members 55 and 56 (i.e., a second seal member) are provided on the mounting portion S1 of the image forming unit main body 23. The seal members 55 and 56 are located on both ends of the receiving opening 45, and contact the outer circumferential surface of the lower half portion 43L along the receiving opening 45. The seal members 55 and 56 are made of resilient material whose hardness is lower than hardness of plate material of the housing Cs2 of the image forming unit main body 23 and the case 43 of the toner cartridge 41. For example, the seal members 55 and 56 are made of urethane sponge. The seal members 55 and 56 have end surfaces facing each other. The seal members 55 and 56 extend in a longitudinal direction of the receiving opening 45 (i.e., in the longitudinal direction of the mounting portion S1). The end surfaces of the seal members 55 and 56 are aligned with inner an peripheral wall of the receiving opening 45.

As shown in FIG. 7, taper surfaces tp1 and tp2 are formed on the inner periphery of the opening 44. The taper surfaces tp1 and tp2 are formed so that a thickness of the inner periphery of the opening 44 decreases toward inside the opening 44. The taper surfaces tp1 and tp2 are formed so as to face outward (i.e., an outer circumferential side) of the lower half portion 43L. When the toner cartridge 41 is mounted to the image forming unit main body 23, portions of the seal members 55 and 56 corresponding the taper surfaces tp1 and tp2 are pressed by the lower half portion 43L. In this state, as shown in FIG. 4, taper surfaces 55*a* and 56*a* are formed on the seal members 55 and 56. The taper surfaces 55*a* and 56*a* are formed so that the thicknesses of the seal members 55 and 56 increase toward inside the opening 44.

Since most part of the inner periphery of the opening 44 is covered with the taper surfaces 55*a* and 56*a*, the toner Tb existing in the vicinity of the opening 44 and the receiving opening 45 is prevented from entering into between the outer circumferential surface of the lower half portion 43L and the mounting portion S1. Further, an area where the inner periphery of the opening 44 faces the toner Tb in the image forming unit main body 23 is reduced. Therefore, the toner Tb is prevented from adhering to the inner periphery of the opening 44.

In this regard, as shown in FIG. 7, in a state where the toner cartridge 41 is detached from the image forming unit main body 23, the seal members 55 and 56 are not pressed by the lower half portion 43L. Therefore, upper surfaces of the seal members 55 and 56 become substantially flat.

As described above, according to the first embodiment of the present invention, the closing portion 50 has the recess portion 51, and therefore the toner T is prevented from adhering to the outer circumferential surface of the shutter 42 when the shutter 42 is in the closing position. Therefore, when the toner cartridge 41 is detached from the image forming unit main body 23, scattering of the toner T can be prevented. Accordingly, components around the opening 44 of the toner cartridge 41 such as, for example, the case 43 of the toner cartridge 41, the housing Cs2 of the image forming unit main body 23 and the housing Cs1 of the printer 10 are not contaminated with the toner T.

COMPARISON EXAMPLE

Figure 8:
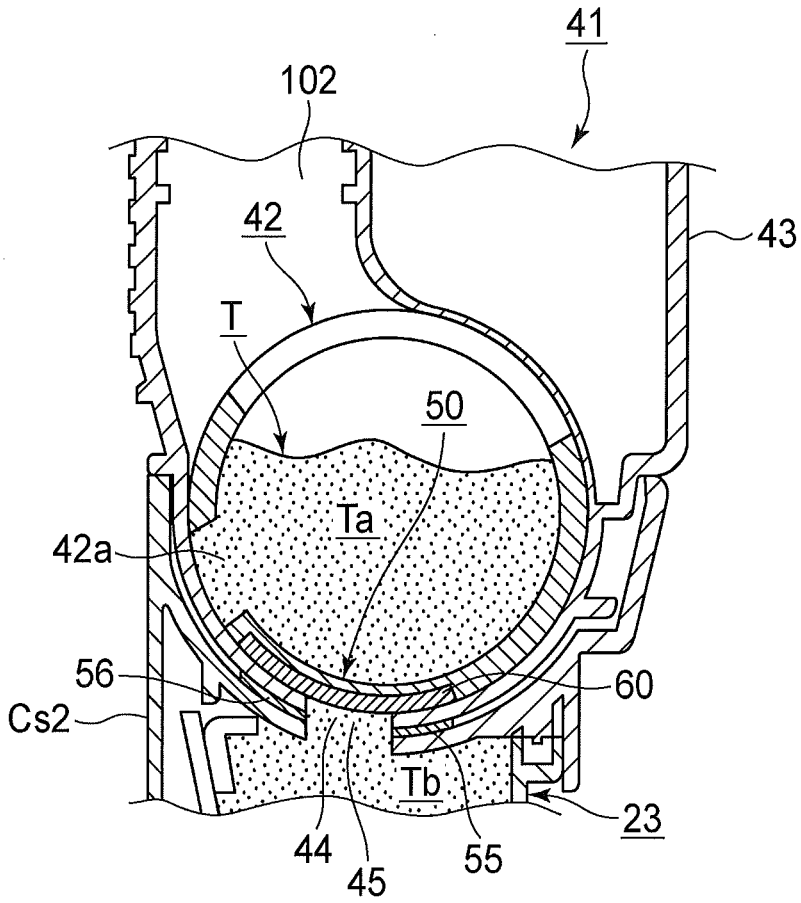
FIG. 8 shows a state where a shutter of a toner cartridge is in the closing position according to a comparison example.
Figure 9:
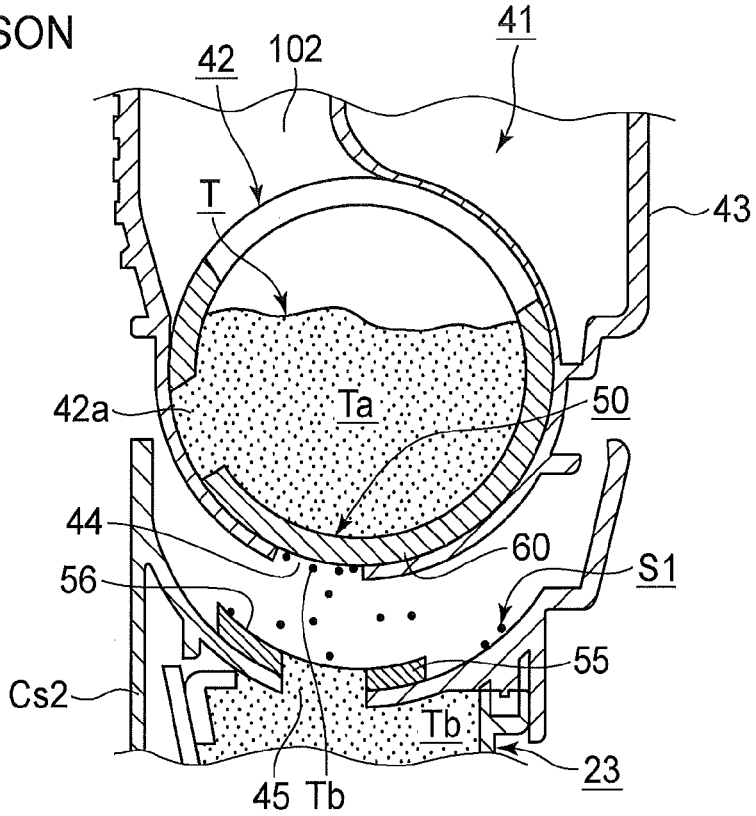
FIG. 9 shows a state where the toner cartridge is detached from an image forming unit main body according to the comparison example.

FIGS. 8 and 9 show a comparison example with respect to the first embodiment. FIG. 8 shows a state where the shutter 42 is in the closing position. FIG. 9 shows a state where the toner cartridge 41 is detached from the image forming unit main body 23. For convenience, same reference numerals as those of the first embodiment are used.

In the comparison example, the recess portion 51 (see FIGS. 4 through 7) is not provided on the closing portion 50. Instead, a seal member 60 is provided on the closing portion 50. When the shutter 42 is in the closing position, the toner T is divided by the closing portion 50 into a toner Ta in the toner storage container 102 and a toner Tb in the image forming unit main body 23. In this state, the toner Tb in the image forming unit main body 23 adheres to the surface of the seal member 60.

Therefore, as shown in FIG. 9, when the toner cartridge 41 is detached from the image forming unit main body 23, the toner T adhering to the seal member 60 may scatter outside. The scattered toner may contaminate components around the opening 44 such as, for example, the case 43 of the cartridge 41, the housing Cs2 of the image forming unit main body 23, and the interior of the housing Cs1 of the printer 10.

Second Embodiment

Next, the second embodiment of the present invention will be described. Components which are the same as those of the first embodiments are assigned the same reference numerals. Regarding advantages obtained by these components, descriptions in the first embodiment are herein incorporated.

Figure 10:
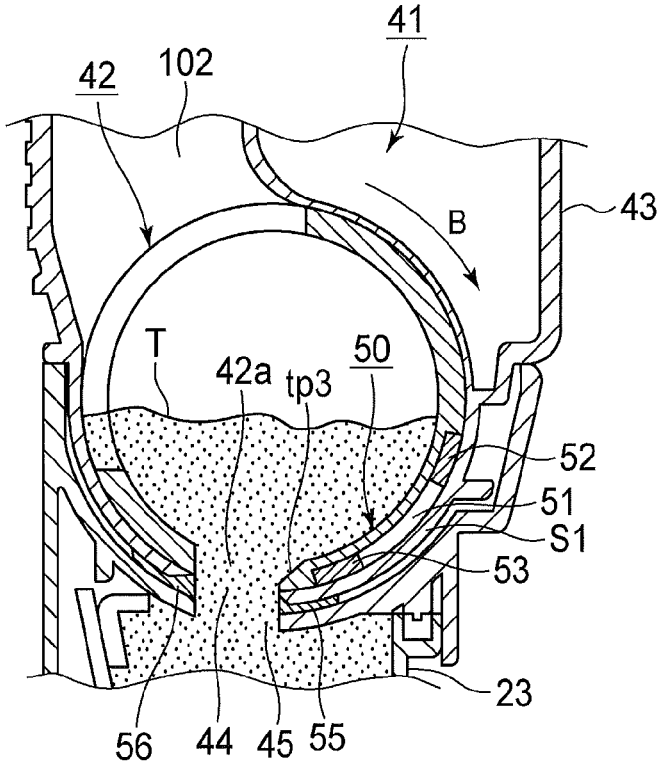
FIG. 10 is a sectional view showing a state where a shutter of a toner cartridge is in a closing position according to the second embodiment of the present invention.
Figure 11:
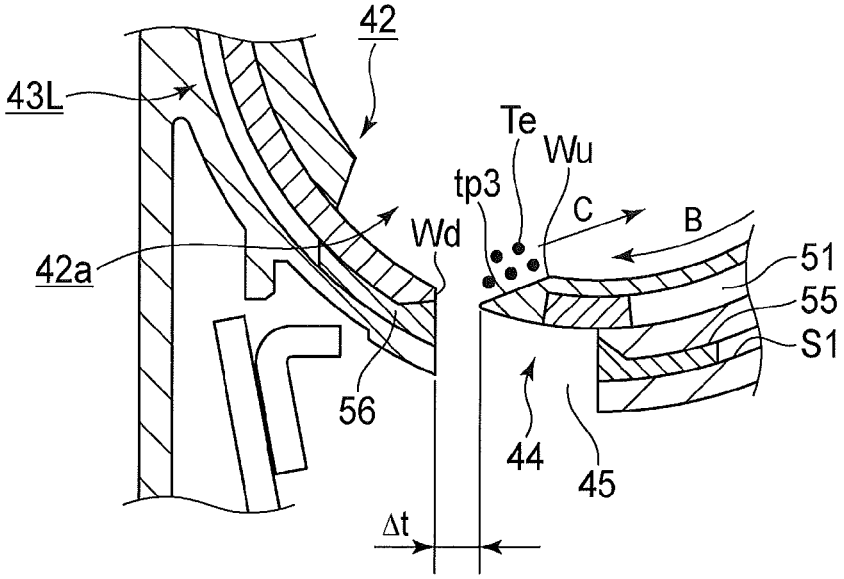
FIG. 11 is an enlarged sectional view showing a main part of the shutter according to the second embodiment.

FIG. 10 is a sectional view showing a state where a shutter 42 of a toner cartridge 41 is in a closing position according to the second embodiment. FIG. 11 is an enlarged sectional view showing a main part of the shutter 42 according to the second embodiment.

The shutter 42 (i.e., an opening-and-closing member or a shield member) has a taper surface tp3 (i.e., slope portion) formed on an inner periphery of a supply opening 42*a* (i.e., developer supply portion). More specifically, the taper surface tp3 is formed on an upstream part Wu (FIG. 11) of the inner periphery of the supply opening 42*a*. Further, the taper surface tp3 is formed so that a thickness of the shutter 42 decreases toward inside the supply opening 42*a*. The taper surface tp3 is located at a downstream side of the recess portion 51 in the rotational direction of the shutter 42 (shown by the arrow B) from the opening position to the closing position. The taper surface tp3 is formed so that a thickness of the shutter 42 decreases toward inside the supply opening 42*a*. The taper surface tp3 is formed so as to face inward (i.e., an inner circumferential side) of the shutter 42.

When the shutter 42 rotates from the opening position to the closing position, the toner T (i.e., developer) is divided into two a toner Ta in toner storage chamber 102 (i.e., a developer storage portion or a reservoir) and a toner Tb in the image forming unit main body 23. In this state, a toner Te existing on or in the vicinity of the taper surface tp3 slides in a direction shown by an arrow C in FIG. 11 along the taper surface tp3. Therefore, a pressure applied to the shutter 42 by the toner Te can be reduced.

Next, description will be made of the pressure applied to the shutter 42 by the toner Te during the rotation of the shutter 42 from the opening position to the closing position. As shown in FIG. 11, a downstream part of the inner periphery of the opening 44 (i.e., a developer opening) is expressed as Wd. A gap between the above described part Wu of the inner periphery of the supply opening 42*a* and the part Wd of the inner periphery of the opening 44 is expressed by At as shown in FIG. 11.

Figure 12:
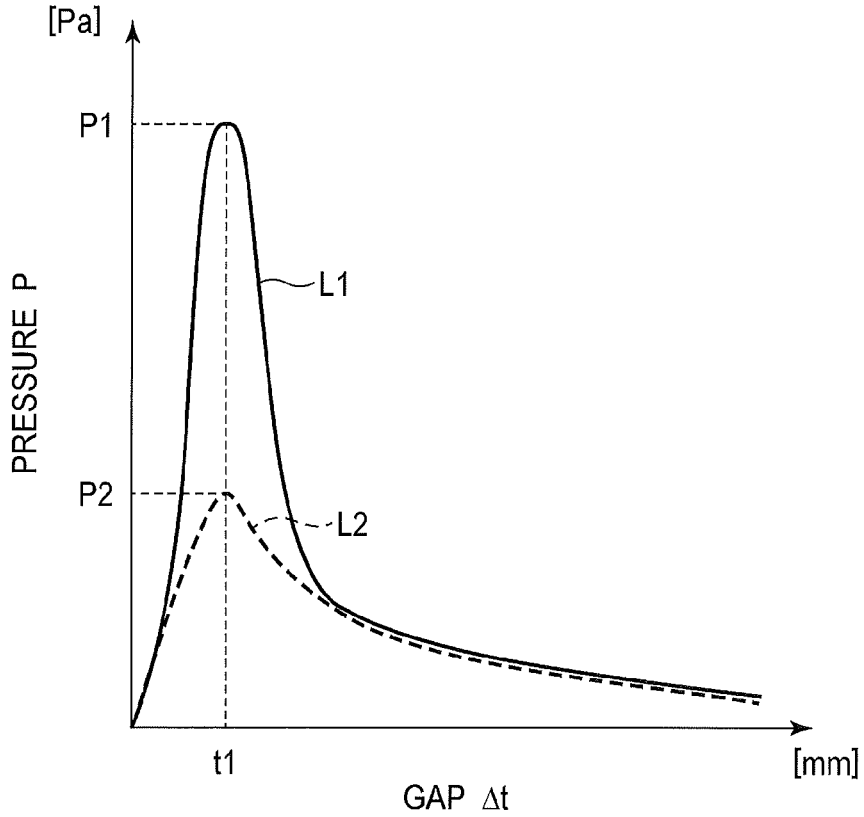
FIG. 12 is a diagram showing a pressure applied to the shutter when the shutter rotates from the opening position toward the closing position.

FIG. 12 is a diagram showing a pressure applied to the shutter 42 when the shutter 42 rotates from the opening position toward the closing position. A horizontal axis shows the gap At (mm), and a vertical axis shows the pressure P (Pa).

A line L1 (shown by a solid line) indicates a pressure P (Pa) when the taper surface Tp3 is not formed on the part Wu of the inner periphery of the supply opening 42*a*. A line (shown by a dashed line) L2 indicates a pressure P (Pa) when the taper surface Tp3 is formed on the part Wu of the inner periphery of the supply opening 42*a*.

As shown in FIG. 12, as the gap At decreases, the pressure P (Pa) increases. The pressure P reaches the maximum value P1 (Pa) when the gap Δt is t1 (mm).

When the taper surface Tp3 is not formed on the part Wu of the inner periphery of the supply opening 42*a*, the pressure P exhibits the maximum value P1 (Pa). When the taper surface Tp3 is formed on the part Wu of the inner periphery of the supply opening 42*a*, the pressure P exhibits the maximum value P2 (Pa). It is understood that the maximum value P2 (Pa) is remarkably smaller than the maximum value P1 (Pa).

As described above, according to the second embodiment of the present invention, the taper surface tp3 is formed on the part Wu of the inner periphery of the supply opening 42*a* of the shutter 42. Therefore, during the rotation of the shutter 42 from the opening position to the closing position, a pressure applied to the shutter 42 by the toner Te can be reduced.

Further, since the pressure (force) applied to the shutter 42 by the toner T can be reduced, the entry of the toner T into between the outer circumferential surface of the lower half portion 43L and the mounting portion S1 can be prevented.

In the above described embodiments, a color printer has been described as an example of the image forming apparatus. However, the present invention is also applicable to a monochrome printer. Further, the present invention is also applicable to an image forming apparatus such as a copier, a facsimile machine, a multifunction peripheral or the like.

While the preferred embodiments of the present invention have been illustrated in detail, it should be apparent that modifications and improvements may be made to the invention without departing from the spirit and scope of the invention as described in the following claims.

What is claimed is:

1. A developer storage container comprising:

a storage portion that stores a developer therein;

an opening configured to eject the developer stored in the storage portion; and an opening-and-closing member that opens and closes the opening;

wherein a concave portion is formed on the opening-and-closing member, the concave portion facing the opening when the opening-and-closing member is in a closing position that closes the opening; and wherein when the opening-and-closing member is in the closing position, a space formed by the opening and a space formed by the concave portion are continuous with each other.

2. A developer storage container comprising:

a storage portion that stores a developer therein;

an opening configured to eject the developer stored in the storage portion; and an opening-and-closing member that opens and closes the opening;

wherein a concave portion is formed on the opening-and-closing member so that the concave portion faces the opening; and wherein the concave portion includes:

a recess portion formed on an outer circumferential surface of the opening-and-closing member; and first and second resilient members provided in the recess portion, the first and second resilient members being disposed apart from each other.

3. The developer storage container according to claim 1, wherein the concave portion includes a regulating portion formed so as to corresponding to the opening.

4. The developer storage container according to claim 1, wherein:

the opening-and-closing member has a supply opening that faces the opening when the opening-and-closing member is in a closing position that closes the opening; and the supply opening has a slope portion located at a downstream end of the concave portion in a direction in which the opening-and-closing member moves from an opening position that opens the opening toward a closing position that closes the opening.

5. The developer storage container according to claim 4, wherein:

the slope portion is formed on an inner circumferential side of the supply opening; and the slope portion is formed so that an end of the supply opening becomes narrower toward a downstream side of the concave portion in a direction in which the opening-and-closing member moves from the opening position toward the closing position.

6. An image forming unit comprising the developer storage container according to claim 1.

7. The image forming unit according to claim 6, further comprising a receiving opening;

wherein the concave portion is concave with respect to the receiving opening when the opening-and-closing member is in a position that closes the opening.

8. The image forming unit according to claim 6, further comprising a receiving opening;

wherein the concave portion is in a position facing the receiving opening when the opening-and-closing member is in a closing position that closes the opening.

9. The image forming unit according to claim 6, wherein the developer storage container is detachably mounted to a main body of the image forming unit.

10. An image forming apparatus comprising the developer storage container according to claim 1.

11. The developer storage container according to claim 2, wherein the concave portion faces the opening in a state where the opening-and-closing member is in a closing position that closes the opening.

12. The developer storage container according to claim 2, wherein the first resilient member is provided on an upstream side of the second resilient member in a direction in which the opening-and-closing member moves from an opening position that opens the opening toward a closing position that closes the opening.

13. The developer storage container according to claim 2, wherein the concave portion further includes:

a first regulating portion provided on an upstream side of the first resilient member in a direction in which the opening-and-closing member moves from an opening position that opens the opening toward a closing position that closes the opening; and a second regulating portion provided on a downstream side of the second resilient member in a direction in which the opening-and-closing member moves from the opening position to the closing position.

14. The developer storage container according to claim 2, wherein the concave portion includes a regulating portion formed so as to correspond to the opening.

15. The developer storage container according to claim 2, wherein:

the opening-and-closing member has a supply opening that faces the opening when the opening-and-closing member is in a closing position that closes the opening; and the supply opening has a slope portion located at a downstream end of the concave portion in a direction in which the opening-and-closing member moves from an opening position that opens the opening toward a closing position that closes the opening.

16. The developer storage container according to claim 15, wherein:

the slope portion is formed on an inner circumferential side of the supply opening; and the slope portion is formed so that an end of the supply opening becomes narrower toward a downstream side of the concave portion in a direction in which the opening-and-closing member moves from the opening position toward the closing position.

17. An image forming unit comprising the developer storage container according to claim 2.

18. An image forming apparatus comprising the developer storage container according to claim 2.

* * * * *